United States Patent [19]

Chrones

[11] 4,378,948

[45] * Apr. 5, 1983

[54] SAFETY CLOSURE LATCH

[75] Inventor: Anthony Chrones, Warwick, R.I.

[73] Assignee: Reliance Products Corporation, Woonsocket, R.I.

[ * ] Notice: The portion of the term of this patent subsequent to Dec. 5, 1994, has been disclaimed.

[21] Appl. No.: 696,486

[22] Filed: Jun. 15, 1976

[51] Int. Cl.[3] ..... E05C 7/00

[52] U.S. Cl. ..... 292/19; 292/76

[58] Field of Search ..... 292/17, 24, 76, 84, 292/125, 87, 91, DIG. 38; 312/215, 333, 348; 16/86 R, 86 B

[56] References Cited

U.S. PATENT DOCUMENTS

| | | | |
|---|---|---|---|
| 618,895 | 2/1899 | Munday | 292/19 |
| 1,094,279 | 4/1914 | Wagner | 292/19 UX |
| 1,147,530 | 7/1915 | Mentz | 292/19 |
| 3,397,001 | 8/1968 | Friedman | 312/348 X |
| 3,801,143 | 4/1974 | Gutner | 292/76 |

*Primary Examiner*—J. Franklin Foss

*Attorney, Agent, or Firm*—Townsend and Townsend

[57] ABSTRACT

The safety closure latch includes a stop member depending from the upper wall of the drawer opening. The stop member is generally rectangular and has a pair of vertically aligned rectangular openings. The latch member is mounted on the inner face of the front vertical wall of the drawer adjacent the top. The latch member comprises a mounting base and a pair of vertically spaced parallel arms extending horizontally from the base into the drawer. Each arm terminates in a hooked end having a shoulder, the hook on the upper arm extending upwardly and the hook on the lower arm extending downwardly. The arms are so aligned that when the drawer is closed, the arms will slide into the aligned openings of the stop member, the hook portion on the upper arm snapping by the upper edge of the upper opening, and the hook portion of the lower arm snapping by the lower edge of the lower opening. When the drawer is pulled open, the hook portions will engage the edges of the openings and prevent the drawer from being opened more than the length of the arms. This prevents small children from getting into the drawer. An adult can reach it with the thumb and forefinger, grasp the arms and squeeze them together. The hooked ends will then clear the openings and the drawer can be opened completely. Since both arms must be cleared, the device provides a double safety latch.

2 Claims, 3 Drawing Figures

SAFETY CLOSURE LATCH

BACKGROUND OF THE INVENTION

Small children are curious and often get into trouble by opening and getting into drawers containing knives, scissors or other dangerous items. It has been proposed to use a safety latch wherein the drawer can only be partially opened by the child, the latch member being positioned so that it can be actuated by an adult to open the drawer completely. Such a construction is illustrated in U.S. Pat. No. 3,397,001 issued Aug. 13, 1968. However, this type of construction is dangerous in that a child could accidentally push or put pressure on the latch and open the drawer.

SUMMARY OF THE INVENTION

The present invention provides a safety latch which comprises, in effect, a double latch, requiring more than a downward pressure to open. A stop member depends from the upper wall of the drawer opening and comprises a depending frame having two vertically aligned rectangular openings. The latch member comprises a mounting base attached to the inner face of the vertical drawer wall. A pair of resilient arms extend horizontally from the base into the drawer in vertically spaced parallel relation. Each arm has a hooked end, the upper hook facing upwardly and the lower hook facing downwardly. When the drawer is closed, the arms enter the openings, the hooked ends snapping by the edges of the openings with a resilient action. When the drawer is pulled open, the upper arm hook engages the upper edge of the upper opening and the lower arm hook engages the lower edge of the lower opening to retain the drawer in partially open position. This is only a few inches, the length of the arms. The latch now requires grasping both upper and lower arms between the thumb and forefinger and squeezing them together. This will clear both hooked ends from their openings and allow the drawer to be fully opened. Thus, pressure on the upper arm will not release the drawer, both latches *must* be actuated. This provides a safety feature against accidental opening by a child.

DESCRIPTION OF THE INVENTION

Figure 1:
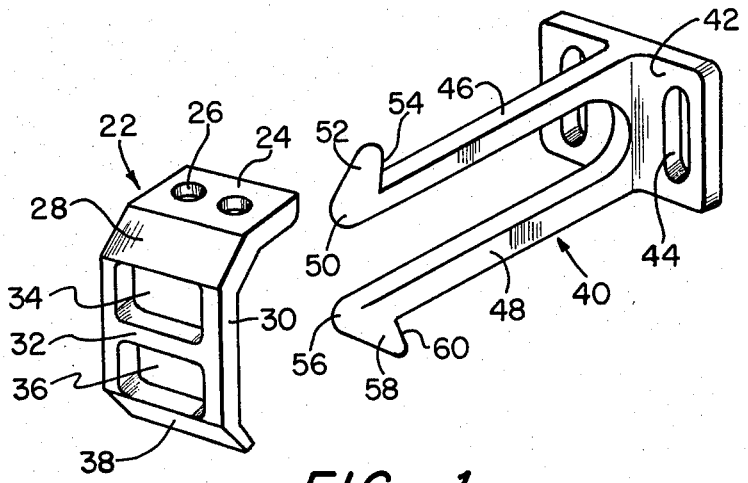
FIG. 1 is a perspective view of a safety latch embodying the present invention.

Referring more in detail to the drawings, the illustration shows a bureau or other receptacle 10 having a top 12 and transverse brace member 14 adjacent the front edge above the drawer opening. The drawer 16 is provided with the vertical front wall 18 and drawer pull or handle 20.

The safety latch of the present invention is more particularly shown in FIG. 1. The stop member 22 comprises a generally rectangular frame having a horizontal upper end 24 for mounting beneath the brace 14, FIGS. 2 and 3, in any desired manner, as by screwing through the openings 26. From the portion 24, the stop member continues with an integral panel 28 slanted inwardly and down at about 45°. Then an integral portion 30 extends downwardly in the form of an open frame having a central cross bar 32 dividing the frame into upper and lower rectangular openings 34 and 36. The lower end of the member 22 is provided with an integral panel 38 bent forwardly to provide the stop member with a generally C-shape. This allows the stop member to be mounted adjacent the front edge of the drawer opening yet provides for clearance for the latch member when the drawer is closed.

Figure 2:
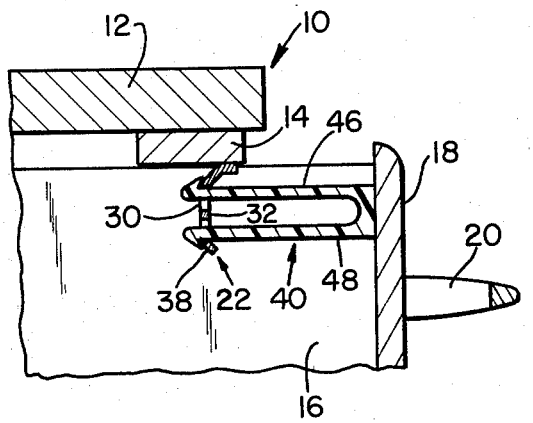
FIG. 2 is a longitudinal section through the drawer and latch with the drawer in partially open position.
Figure 3:
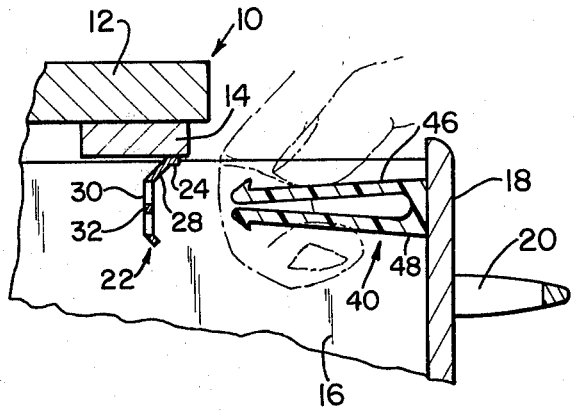
FIG. 3 is a view similar to FIG. 2 showing the latch in opened position.

The latch member 40 comprises a rectangular base 42 for mounting on the inner side of the front drawer wall 18, FIGS. 2 and 3, by any suitable means. When screws are used, slots 44 allow for vertical adjustment for alignment with the stop member 22. Extending horizontally integrally from the base 42 are a pair of resilient vertically aligned parallel latch arms 46 and 48. The upper arm 46 terminates in a pointed end 50 having a rearwardly and upwardly slanted cam surface 52 terminating in an abrupt shoulder 54. The lower arm 48 also terminates in a pointed end 56 having a rearwardly and downwardly slanted cam surface 58 terminating in an abrupt shoulder 60.

The latch member 40 is so aligned with the stop member 22 that when the drawer 16 is pushed closed, the upper arm 46 slides through the upper opening 34 with the cam surface 52 engaging the upper edge of the opening and sliding by with a snap action. Similarly and simultaneously, the lower arm 48 slides through the lower opening 36 with the cam surface 58 engaging the lower edge of the opening and sliding by with a snap action. Now, when the drawer is pulled open, FIG. 2, the shoulder 54 on the upper arm 46 will engage the upper edge of the upper opening 34 and the shoulder 60 on the lower arm 48 will engage the lower edge of the lower opening 36. This will prevent the drawer from being opened more than the length of the arms 46 and 48.

In this position, accidental pressure on the upper arm 46 will not disturb the lower arm and will not cause the latch to open accidentally. Positive action is required. As shown in dotted lines in FIG. 3, the arms 46 and 48 are grasped between the thumb and forefinger and squeezed toward each other. This releases both shoulder portions simultaneously and allows the drawer to be pulled completely open.

I have thus provided a simple latch construction for a drawer or the like which provides a double safety catch which protects against accidental opening. Only a positive unlatching action on both latch members will allow the drawer to be opened. Other advantages of the present invention will be readily apparent to a person skilled in the art.

I claim:

1. A safety closure latch for a drawer or the like comprising a stop member and a complimentary latch member for releasably retaining said drawer in partially open position, said stop member comprising a base for mounting in the drawer opening and an elongated downwardly depending frame integrally from said base, said frame provided with at least one opening defining an upper edge and a lower edge forming upper and lower shoulders respectively for engaging said latch member, said latch member comprising a base for mounting to the inner face of the front drawer wall, with a pair of resilient arms extending horizontally inward from said base in alignment with the opening in said stop member, said arms being in vertically spaced parallel relation, the outer ends of said arms provided with hooked portions, the hooked portion on the upper of said arms facing upwardly to engage the upper shoulder of said stop member and the hooked portion on the lower of said arms facing downwardly to engage the lower shoulder of said stop member.

2. A safety closure latch as in claim 1, wherein said frame of said stop member is provided with a pair of vertically aligned rectangular openings, and said upper and lower shoulders are defined by the upper edge of the upper opening and the lower edge of the lower opening, respectively.

* * * * *